United States Patent [19]

Richter

[11] Patent Number: 4,558,469

[45] Date of Patent: Dec. 17, 1985

[54] FASHION TRIM ARTICLE

[75] Inventor: Herbert Richter, Pforzheim, Fed. Rep. of Germany

[73] Assignee: Herbert Richter Metallwaren-Apparate bau GmbH & Co., Pforzheim-Bü, Fed. Rep. of Germany

[21] Appl. No.: 639,724

[22] Filed: Aug. 13, 1984

[30] Foreign Application Priority Data

Aug. 16, 1983 [DE] Fed. Rep. of Germany ... 8323502[U]

[51] Int. Cl.[4] ..... A41D 27/16

[52] U.S. Cl. ..... 2/60; 2/46; 2/129; 2/132; 2/244; 24/170; 24/191

[58] Field of Search ..... 2/60, 46, 132, 152 R, 2/157, 244, 246, 129; 223/44; 24/170, 191

[56] References Cited

U.S. PATENT DOCUMENTS

| | | | |
|---|---|---|---|
| 2,807,849 | 10/1957 | Legat | 24/170 X |
| 2,819,469 | 1/1958 | Lyles | 2/60 |
| 3,042,986 | 7/1962 | Racette et al. | 24/170 |
| 3,085,247 | 4/1963 | Bixby | 2/46 |
| 3,213,502 | 10/1965 | Albiniano | 24/191 |
| 3,608,158 | 9/1971 | Bengtsson | 24/170 |

*Primary Examiner*—Werner H. Schroeder
*Assistant Examiner*—J. L. Olds
*Attorney, Agent, or Firm*—Klaus J. Bach

[57] ABSTRACT

A fashion trim article for the protection and decoration of corners of cloth such as collars and ties comprises an angled enclosure formed and stamped from a sheet and having a front plate with bent-up and -over side sections and a back plate spaced from the front plate for receiving therebetween the cloth corner.

The back plate has outwardly bent parallel bearing wall sections with opposite bores receiving the bearing pins of a pivotable retaining flap provided with a tab projecting into the opening defined between the bearing wall sections for engaging the cloth material introduced into the space between the front and back plates. The tab on the retaining flap not only engages the material to retain the material but also moves the material further into the trim member when the flap is closed.

6 Claims, 2 Drawing Figures

FASHION TRIM ARTICLE

BACKGROUND OF THE INVENTION

The invention relates to a fashion trim article for the protection and decoration especially of corners of clothing pieces such as collars, of shirts and jackets, ties, etc.

Such trim articles are manufactured only as shirt collar edges enclosures in a relatively expensive way; first pockets are cast which have bearing structures next to the pocket opening, then holes are drilled into the bearing structures, a retaining flap is also cast into which holes are also drilled and both parts are linked together by insertion of a pin. Herein, not only the manufacture of the molded pieces per se but also the drilling of the holes into the pieces and their assembly are quite expensive. Further, the insertion of the pin into the holes and its cutting from a wire and deburring is quite time consuming.

Trim articles manufactured in this manner therefore did not become popular, mainly because they were too expensive at the point where they arrived at the consumer. Furthermore, this kind of trim article has retaining flaps mounted thereon by hinges in the form of single arm levers which, when pivoted, force pointed edges formed on the flaps into the shirt collars, thereby to retain the trim edges. If, however, a collar corner is not fully inserted into a trim edge, the relatively expensive trim article may be lost.

It is, therefore, the object of the present invention to provide fashion trim articles which are relatively inexpensive to manufacture and which, furthermore, are so formed that they are firmly retained and will not be lost.

SUMMARY OF THE INVENTION

In a fashion trim article for the protection and decoration of portions of clothing such as collars, sleeves and ties, an angled enclosure is formed from a stamped metal part so as to have a front plate with bent-up and -over side and back plate sections. The back plate sections are spaced from the front plate and have outwardly bent parallel bearing walls with opposite bores receiving the bearing pins of a pivotable L-shaped retaining flap having a tab projecting into the opening formed between the outwardly bent bearing walls for engaging cloth material introduced into the space between the front plate and back plate sections.

The manufacture of such fashion trim articles as stamped metal parts is already substantially less expensive than the manufacture of the same parts by casting. Such stamped metal parts can be manufactured in large numbers on fully automated stamping equipment without the requirement for manual finishing procedures. The same applies to the retaining flaps which, in accordance with the invention, are L-shaped and which have the bearing pins arranged at the corner of the L shape. The bearing walls bent out from the stamped metal part provide therebetween an opening for the engagement of cloth material (collar). This retaining flap arrangement is quite inexpensive to manufacture. Also, the two-arm, L-shaped retaining flap will not only engage the collar but also move the collar edges fully into the trim article when the retaining flap is closed. Disengagement of the trim article or its loss is therefore practically impossible.

When the retaining flap is pivoted into its retaining position, the short arm (tab) of the L-shaped flap, which is serrated or which has an edge of elastomeric material, engages the collar material which is generally slightly resilient. Since the tab is pivoted beyond a position normal to the back side of the trim article front plate, the flap is resiliently and firmly held in this position so that additional locking means are not necessary. However, in one embodiment of the present invention, protrusions are provided on the bearing walls, which protrusions are disposed so as to project inwardly toward one another such that, upon pivoting of the flap, the flap is moved past the protrusions which are forced apart by the flap and lock the flap in its retaining position. In addition, the L-shaped retaining flap may be bent to an acute angle and curved such that the free end of the flap operating lever also abuts the collar material and engages it for even firmer engagement with the collar.

Since the fashion trim article according to the invention may be manufactured very inexpensively, its application is not limited for use in connection with shirts but fashionable trim articles may also be used in connection with other clothing such as collars, sleeves of jackets and shirts, ties, etc.

SHORT DESCRIPTION OF THE DRAWINGS

FIG. 1 is a rear view of a fashion trim article according to the invention; and FIG. 2 is a view in the direction of arrow II of FIG. 1.

DESCRIPTION OF THE PREFERRED EMBODIMENT

Figure 1:
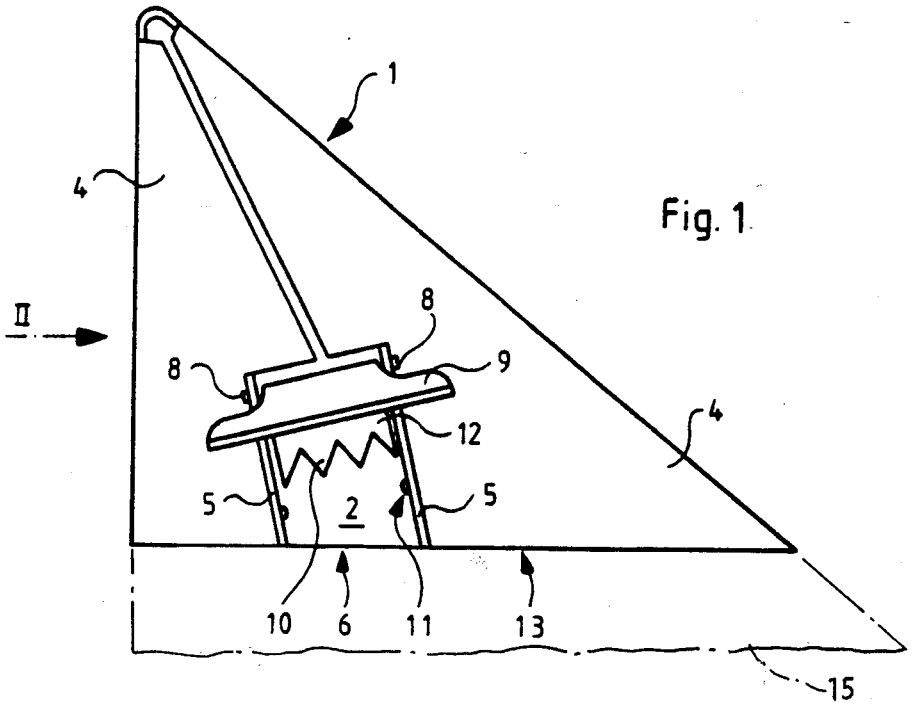

In accordance with the invention, the fashion trim article shown as a corner 1 is a stamped metal member consisting of a plate 2 which forms the front side and from which side sections 3 are bent out and further bent over to form a back plate member 4 spaced from the front side and adapted to receive the corner area 15 of cloth material such as a collar corner. Bearing walls 5 are bent out of the back plate 4 so as to project at a right angle therefrom defining therebetween an opening 6. The bearing walls 5 have opposite bores 7 receiving the pivot pins 8 of an L-shaped retaining flap 9, thereby pivotally supporting the flap 9. The end tab 12 of the L-shaped retaining flap 9 is serrated at its free end, that is, it has prongs 10 or it may be provided with an edge 14 of elastomeric material (FIG. 2) for the engagement of cloth material.

Figure 2:
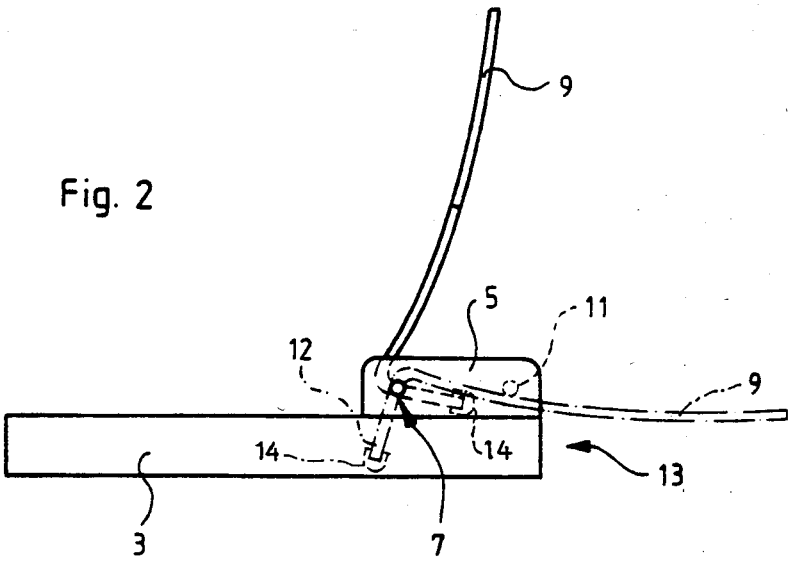

The flap 9 is so supported by the bearing walls 5 that it is pivotal between a release position as shown in full in FIG. 2 and an engaging position as shown in FIG. 2 in dash-dotted lines. In its engaging position, the operating arm of the flap 9 is disposed beyond protrusions 11 which are formed opposite one another from the bearing walls 5 so that the flap 9 is locked in its engaging position. Upon pivoting of the flap 9 into the locked position, the tab 12 of the flap 9 is moved into the space 13 enclosed between the front and rear plate sections 2, 4 of the trim article 1 so that it engages the corner area 15 of a cloth material such as a collar corner inserted into the trim article and moves it further inwardly into the space 13 toward the edge of the trim article 1. When the operating arm of the flap 9 is pivoted toward the back plate 4 it is engaged by the protrusions 11 and the tab 12 is pivoted over-center, thereby firmly holding the flap 9 in its retaining position. At the same time, the free end of the operating arm of the flap 9 abuts the material inserted into the trim article, thereby further holding the trim article in position and in alignment with the material.

I claim:

1. A fashion trim article for the protection and decoration of corner areas of cloth such as collars of jackets and shirts, said trim article consisting of an enclosure comprising a front plate and back plate sections arranged spaced from the front plate by side walls, said front and back plate sections and said side walls being formed from stamped metal bent up and over to form said side walls and said back plate sections, said back plate sections having portions bent outwardly so as to provide an opening therebetween and to form opposite parallel bearing walls projecting from said back wall sections, said bearing walls having axially aligned bores formed therein, and a retaining flap having bearing pins pivotally supported in said bores of said bearing walls, said retaining flap having an operating lever and a tab projecting inwardly into said opening in said back plate sections between said bearing walls for engaging therein cloth material introduced between said front plate and back plate sections.

2. A fashion trim article according to claim 1, wherein said retaining flap is bent to an L shape providing angled sections, one forming said operating lever and the other said inwardly projecting tab and said bearing pins are sections projecting outwardly into said bores at the jointure of said angled flap sections.

3. A fashion trim article according to claim 1, wherein said inwardly projecting tab of said L-shaped flap is serrated at its free end.

4. A fashion trim article according to claim 1, wherein the inwardly projecting tab of said L-shaped flap is provided with an edge of an elastomeric material.

5. A fashion trim article according to claim 1, wherein said L-shaped flap is bent at an acute angle with the operating lever being curved so as to abut with its free end the cloth received in said enclosure when said flap is in its retaining position.

6. A fashion trim article according to claim 1, wherein at least one of said bearing walls has formed thereon a protrusion extending therefrom toward the other bearing wall, said protrusion being so arranged as to engage and lock the operating lever of said L-shaped flap in its retaining position.

* * * * *